United States Patent [19]

Walters

[11] 4,168,764

[45] Sep. 25, 1979

[54] LEVEL STEP STAIR WALKWAY

[76] Inventor: Tom Walters, 2102 Mason Blvd., Point Pleasant, W. Va. 25550

[21] Appl. No.: 899,528

[22] Filed: Apr. 24, 1978

[51] Int. Cl.[2] ..... E06C 9/06; E04F 11/04

[52] U.S. Cl. ..... 182/1; 182/96

[58] Field of Search ..... 182/1, 96

[56] References Cited

U.S. PATENT DOCUMENTS

| | | | |
|---|---|---|---|
| 298,212 | 5/1884 | Knight | 182/1 |
| 1,419,834 | 6/1922 | Fellows | 182/1 |
| 1,944,159 | 1/1934 | Bailey | 182/1 |
| 4,013,140 | 3/1977 | Pradon | 182/1 |

*Primary Examiner*—Reinaldo P. Machado

[57] ABSTRACT

Self adjusting stair walkway with double side handrailing keyed and hinged to opposed side bar hinge linkage configurations that have steps hinge supported in a manner that upon the main side bars being swung in an arc about its support hinge the steps remain level for practical use as a safe self supporting stairway suitable for pedestrian traffic from seventy-five degrees below the horizontal to sixty degrees above the horizontal then folds to an essentially vertical compactness upon reaching ninety degrees above the horizontal to a standby position. Opposed side gears hydraulically driven are provided for safely swinging the level step stairs that will hydraulically lock the stairs in a desired inclination whereupon controllable opposed ratchet and pawl configurations can safely and additionally lock the stairs in the position.

25 Claims, 20 Drawing Figures

LEVEL STEP STAIR WALKWAY

This invention relates in general to hinged swing type walkways at loading and unloading platforms and docks that are used for an access means for servicing tank cars, tank trucks and barges and the like when loading and unloading liquids, gases, cargo and the like. These platforms and docks are generally stationary with a multitude of piping and other facilities attached.

Swing type walkways are used at such facilities to lower from a vertical position to reach out to the tank car, tank truck, barge and the like. Tank car and tank trucks come in so many sizes that it is impossible to set the height of these fixed platforms in a manner that a swing walkway, that is not adjustable, can safely service the various tank car and tank truck sizes from any given fixed platform height.

Model 21 of the present invention relates in particular to the automatic self adjusting level step stair type walkway, an improvement on my previous automatic self adjusting walkway design, that from a selected fixed platform height can safely service tank cars from 6,000 gallon capacity to 48,000 gallon capacity sizes. This range of versatility improvement is accomplished by hinge configurations that provide a practical 75 degree swing movement from below the horizontal to a 90 degree swing movement above the horizontal. Tank truck servicing is substantially comparable to tank car servicing.

Model 22 design of the present invention is identical to model 21 design except that the drive key shafting can be positioned to provide a 135 degree free swing movement of the level step stair complex, such as could be the condition when the outer and tip step is supported by a barge and the like with the rise and fall of the barge providing the stair swing movement force.

Due to the nature of tank car servicing, such as a fixed regulated minimum distance between the railroad track and adjacent loading platforms which generally has a fixed height above the top of track rail causing the more complex problems, the design of the present invention especially relates to solving these problems in a practical manner.

Access to tank cars from loading platforms used to be on a twelve inch hinged wood plank swinging down by a hand rope to land on a wooden plank affixed to the tank car just below the fill dome. Tank cars then became more sophisticated, larger in size, with a small platform around the fill dome and a neat handrail around the platform except at small ladders each side. The opening in the handrail to these ladders is thirteen and one-half inches, with the twelve inch plank in mind. Later some tank cars provided a twenty two inch opening. Subsequently the twelve inch plank was replaced by sophisticated swing walkways up to two feet wide which soon became a mandatory minimum width, then they could not fit into the tank car handrail opening. They had to be wedged against the tank car structure for the tip end support since they were not self supporting until swung down to the horizontal where they were supported by a cable. These straight plank type walkways are not designed for practical applications below the horizontal.

Some swing type walkways are spring loaded to make them balance lighter for hand roping back up. When a large size car is to be serviced and the loading platform height was fixed to service smaller cars, the walkway can only be lowered 45 degrees to 70 degrees before it hits the tank car structure. These walkway inclinations can be hazardous unless the tip of the walkway is jammed to wedge tight against the tank car structure or tied to it. These spring loaded type walkways quite often raise back up to the vertical when the pedestrian steps onto the tank car. By their nature of their designs to be light enough walkways to be handled by a hand rope, and substantially having a free 90 degree swing, they are not self supporting all positions and lack a desired ruggedness.

It is therefore an object of the present invention to provide industry with a variety of safe sturdy self supporting automatic self adjusting level step stair walkways. Designs that provide a 135 degree practical usable safety step positioning with a larger safety work step at the outer end along with a handrail and step fold up control feature providing a vertically positioned compactness of the apparatus at standby position. Designs that provide positive mechanized control of the apparatus movement along with safety lock devices all positions. Designs that provide a free swing movement of the apparatus at barge dock and the like applications and that can be of greater lengths and widths with a cable winch drive in lieu of a gear drive and used as gangways at ship dockage. Designs that provide face mounted, self contained packaged units with no parts below the loading platform, and designed to bolt on top of a platform and minimize piping changes at existing loading platforms adaptions. Designs that provide rugged OSHA safe handrailing and a choice of hydraulically driven gears, spur as well as hellical. Designs that feature dual balanced drive for raising and lowering the swing movement, and controllable dual ratchet and pawl adaptations for added position safety locks.

Further, to introduce the design featuring a handrail quadrangle linkage compatible with the step parallelogram supporting linkage that with the use of a by pass linkage configuration at the intermediate steps provides parallelogram linkage configurations in the upper quadrant swing movement that enter the horizontal plane when the steps are all in a horizontal plane then the supporting linkage reverses to another parallelogram linkage in the lower quadrant of the swing movement while the handrailing remains compatible in quadrangular linkage in both quadrants.

In accordance with the present invention, an outer step is hinged to two sets of opposed side hinge bars that receive and position shafts of opposed crank type by-pass hinge links between each set of said side bars at intermediate step positions. The intermediate steps are keyed to the inner shafts of the by-pass hinge link to maintain said step parallel to the long axis of the by-pass hinge link. The opposed hinge linkage bar configurations are comprised of outer hinge bars, middle hinge bars as the crank type by-pass linkage bars, and inner hinge bars that are the driven bars that are affixed to a hollow axle that has its ends notched to subsequently receive drive keys. Pins on the inner end of the outer hinge link bars are received within radially slotted brackets affixed to a supporting frame to hinge therein. Said axle is positioned into the supporting frame swing hinge area wherein the axle receives a drive shaft that protrudes past each end of the axle to receive a drive key, keyed ratchet gear, keyed spur gear and an anchoring bearing each end that is affixed to the supporting frame. The drive keys are maintained radially by keeper sleeves. Rack gears to engage said spur gears are supportingly guided from said support frame and driven by hydraulic cylinders powered by a reservoired hydraulic hand pump to evenly actuate said cylinders in a balanced manner at the raising and lowering of the apparatus. A lever is provided to disengage the pawls from the ratchet gears when swing lowering the steps. Said lever can provide pawl engagements on swing raising the steps to automatically lock any stair inclination position. Opposed hinged handrailing is provided that is anchor hinged to the outer step hinge shaft and inwardly to the supporting frame in a manner to be safely usable when the stair inclination angle is from seventy-five degrees below the horizontal to sixty degrees above the horizontal.

These together with other objects and advantages which will become subsequently apparent reside in the details of construction and operation as more fully hereinafter described and claimed, reference being made to the accompanying drawings forming a part hereof, wherein like numerals refer to like parts throughout.

Figure 9:
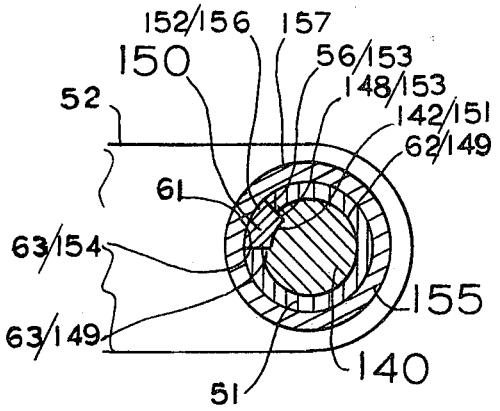
FIG. 9 is a sectional view of model 21 drive shaft, inner hinge bar axle and drive key relation showing full contact of drive key and axle keyway.

Referring now to the drawings in detail, FIGS. 1, 2, 3, 5, 6, 7, 8, 9, 10, 11, 15, 16, 17, 18, 19 and 20 show typical automatic adjusting level step stair walkways, designated as model 21 and model 22. The model designs are identical except model 22 features a 135 degree free swing movement as well as gear driven movement, as indicated in FIGS. 5, 6, 7, 8, 19 and 20, intended for barge dock and the like applications. The free swing movement has been omitted in model 21, as indicated in FIG. 9, for tank car and tank truck service platform applications. Model 21 and 22 differences will be further explained later.

Figure 15:
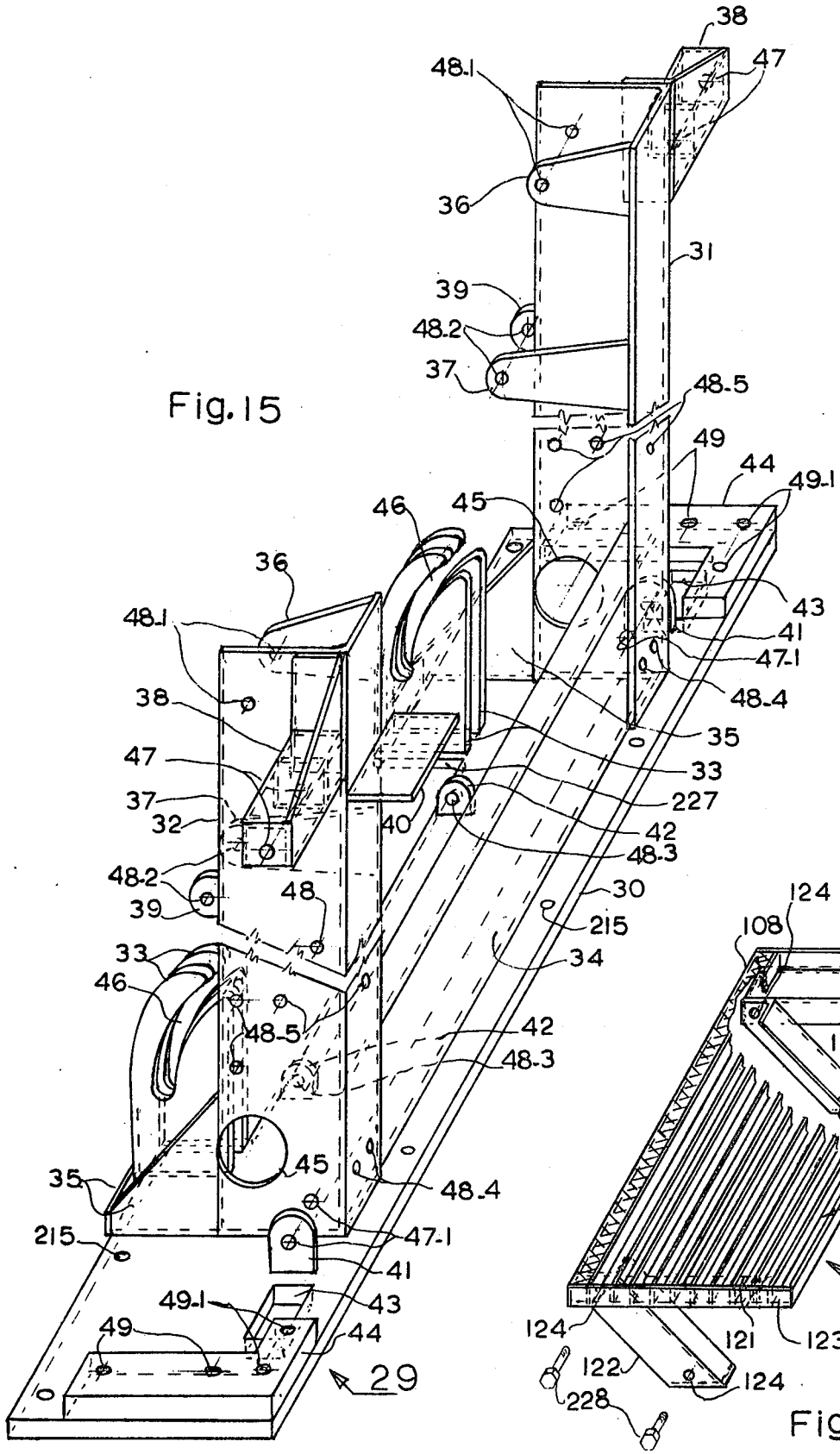
FIG. 15 is a perspective view showing the supporting frame 29 of the present invention.

A supporting frame weldment 29 as seen in FIG. 15 is provided with base plate 30, upright angles posts 31 and 32 braced by transverse channel 34 and bracket plates 35. Bracket plates 36, 37, and 39 are affixed to post 31 and 32 each having holes 48-1 and 48-2 to receive handrail hinge bolting 223 and 223-1. Plate 40 is affixed to post 32 for the support of hydraulic pump 195. Bracket weldments 38 with holes 47 to receive bolting 221 for hinge supporting hydraulic cylinders 130 are affixed to post 31 and 32. Bracket plates 33 with radial slots 46 to receive hinge pins 226 on bars 64 are affixed to plate 30. Lugs 41 with holes 47-1 aligned with holes 47-1 on post 31 and 32 to receive pawl hinge bolting 224 are affixed to plate 30. Lugs 42 with holes 48-3 to receive alignment pins 228 at holes 124 of fixed step 120 are affixed to plate 30. Holes 43 are provided in plate 30 for passage of rack gears 135. Plates 44 with tapped holes 49-1 to receive bolting 229-1 at holes 212 of support weldments 210, 220 and tapped holes 49 to receive bolting 229 for pillow block bearings 200. Weldments 210 and 220 are also bolted at holes 213 with bolting 230 to post 31 and 32 at holes 48-5. Bolting 176 of pawl control device plate 175 is received at hole 48 on post 32. Holes 45 in post 31 and 32 are provided to loosely receive ends 59 of axle 51 of configuration 50, which receives drive shaft 140, and spacer sleeves 155 for retaining keys 150. Plate 30 has cut out 227 to permit inner hinge bars 52 to swing below the horizontal. Holes 215 are provided in plate 30 for securing frame 29 to a loading platform. Post 31 and 32 have holes 48-4 to receive bolting 225 for securing pawl control cross shaft 170 at holes 170-2 of brackets 184.

Figure 19:
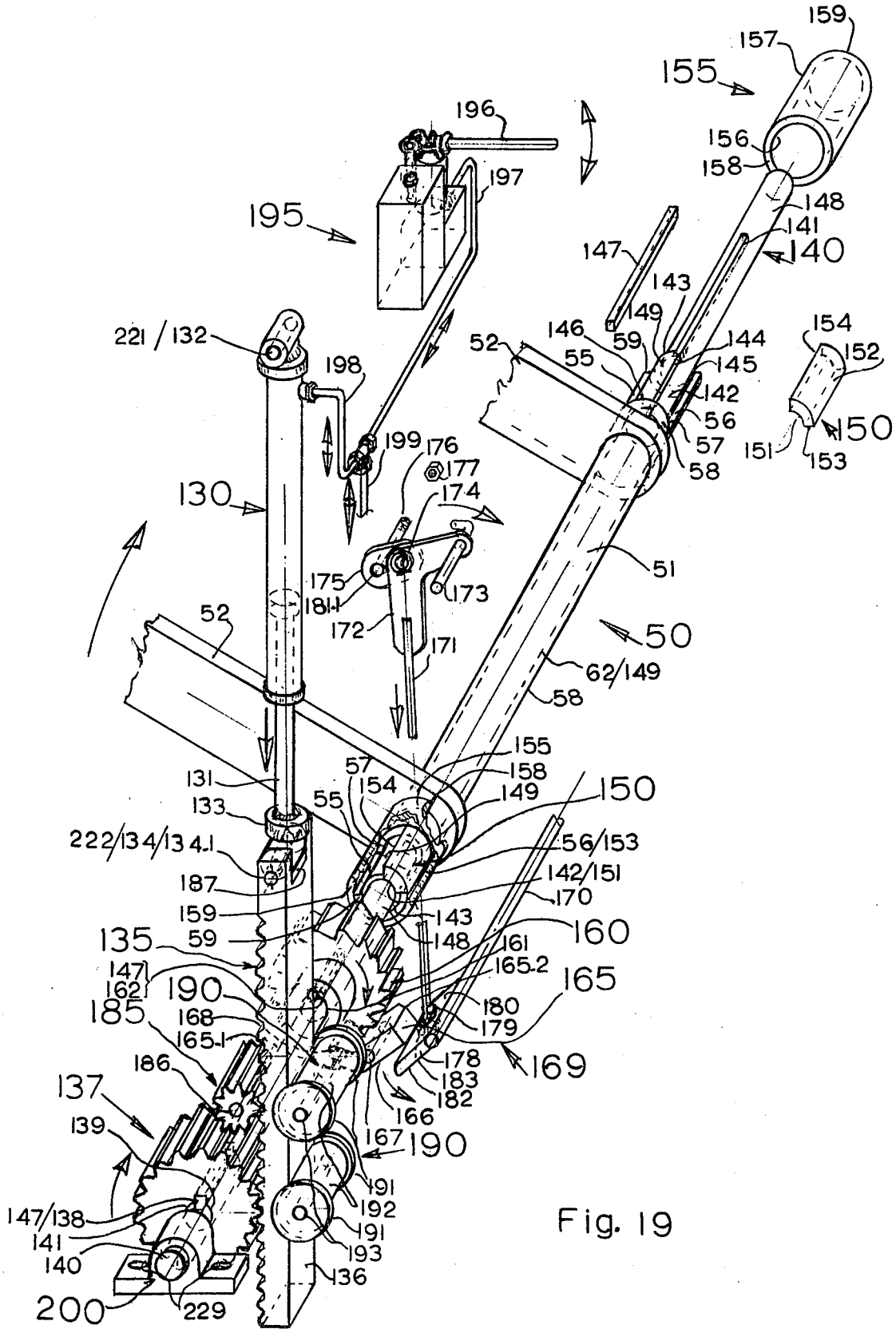
FIG. 19 is a perspective view partially showing the drive mechanism with ratchet gear and pawl control provided in the present invention.
Figure 20:
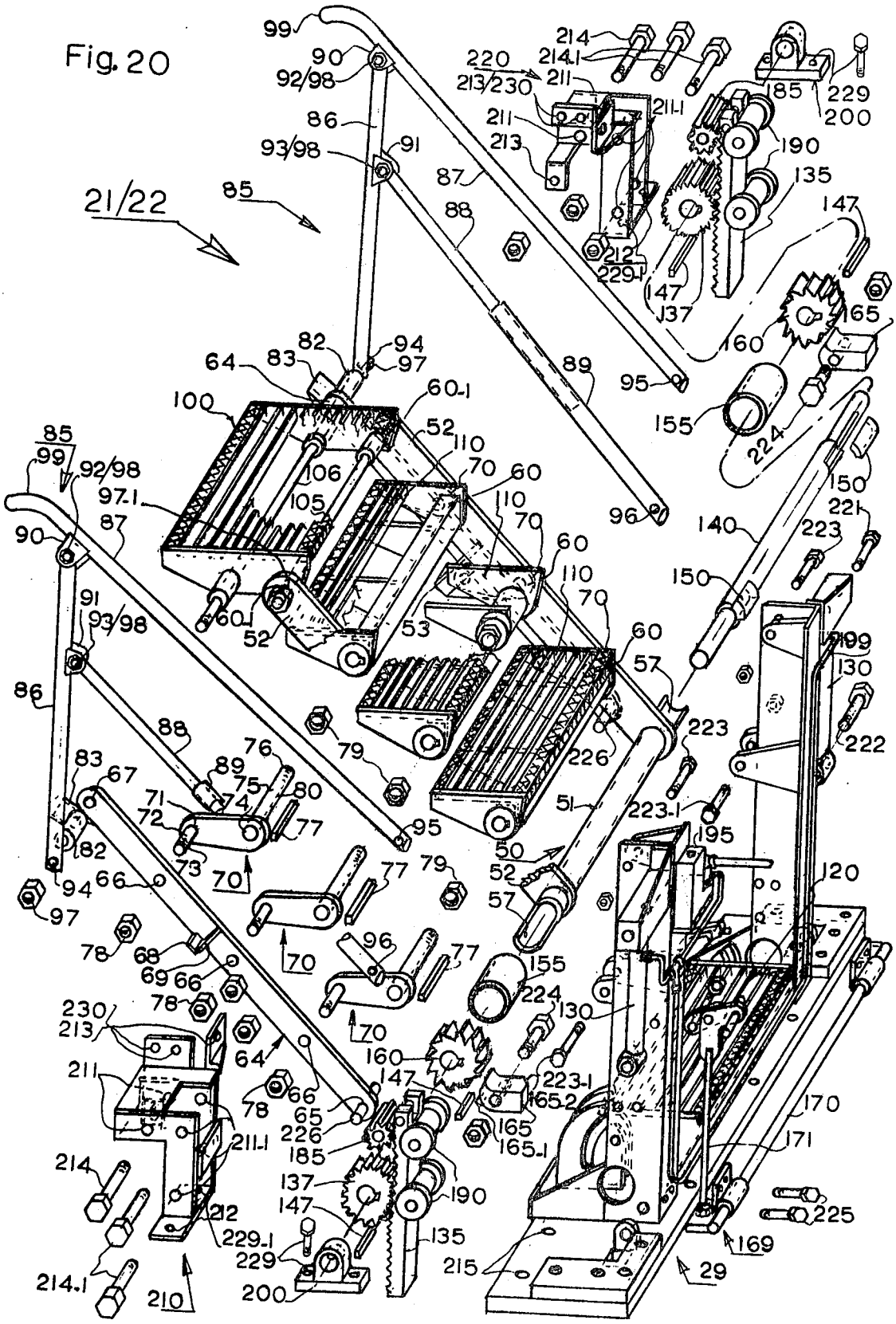
FIG. 20 is essentially an exploded perspective view showing the parts of model 22 of the present invention.

The inner swing hinge linkage configuration 50, shown more decidely in FIGS. 19 and 20 is provided with parallel bars 52 affixed at the configuration hinge end to hollow axle 51. Bars 52 have holes 60-1 to receive hinge shaft 105 received in bore 107 of hubs 104 on outer step 100 and secured thereon by cotter pinned nuts 97-1, holes 60 to receive hinge shafts 75 of crank type by-pass hinge 70, and bracket 54 with abutment angle 53 affixed that triggers the step fold up action when said bars are positioned vertically in the upper quadrant. Axle 51, as seen more clearly in FIGS. 5, 6, 7, 8 and 19, has bore 62 to slidably receive cylindrical surface 149 of drive shaft 140, keyway notch 57 on model 22 forming contact edges 55 and 56 to subsequently contact edges 154 and 153 alternately of drive key 150. The function of notch 57, with drive shaft 140 positioned in a manner that its keyways 142 receives drive key 150 with side edges 154 and 153 partially seated in seat 142 and contacting seat side edges 144 and 145 respectively of 140, is to provide controllable free rotation of 135 degrees movement for axle 51 about shaft 140 as may be desired at barge dockage applications. The function of notch 61 for model 21, as seen more clearly in FIG. 9 wherein said axle free movement has been omitted by said notch 57 replaced by notch 61 with side edges 63 and 56 firmly contacting drive key 150 side edges 154 and 153 respectively, is to provide full contact control of rotation movement of axle 51 through shaft 140 rotation. Cylindrical sleeves 155, with abutment ends 158 and 159 to be rotatably confined between outer face of bars 52 of 50 and inner face of ratchet gear 160 respectively, surface 157 to slidably pass through hole 45 of angles 31 and 32, has inner bore 156 that is slidably positioned over outer cylindrical surface 152 of drive keys 150 and outer cylindrical surfaces 58 of axle 51 in a manner to maintain inner surface 151 of drive key 150 positioned in key seat 142 of shaft 140.

Outer hinge link bars 64 are provided with hole 65 to receive hinge pin 226, affixed therein and subsequently received in radial hinge slots 46 of plates 33 of supporting frame 29, holes 66 to receive hinge shafts 72 of by-pass hinges 70, holes 67 to receive hinge shaft 106 received in bores 107 of hubs 103 on outer step 100 and secured thereon by cotter pinned nuts 97, abutment angle 68 with bracket plate 69, and abutment angle 83. Abutment angle 83 is provided to control the handrail position in the upper quadrant during the vertical fold up of the apparatus to standby position. Abutment angle 68 is affixed to bar 64 in a manner that upon a 60 degree upward swing rotation of the steps from the horizontal plane abutment 53, affixed to hinge bars 52, abut angle 68 and begin to lift the outer bar hinge linkage configuration as bars 52 are rotated on up to the vertical position. As the lifting movement begins, hinge pins 226 in bars 64 guidely travel substantially upward in the radial slots 46 provided in plates 33 of supporting frame 29, and steps 100 and 110 each rotate upward from their horizontal plane to a 45 degree pitch as the quadrangle hinge linkage changes due to bars 64 being raised. A practical compactness of the apparatus is thus obtained to provide the maximum clearance between the apparatus at standby position and the traffic of barges, tank cars, tank trucks and the like.

Crank type by-pass hinge bars 70 are provided with hole 71 to receive, and be affixed therein, hinge shaft 72 with threads 73 to be received within holes 66 of bars 64 and be secured therein by cotter pinned nuts 78, hole 74 to receive, and be affixed therein, hinge shaft 75 with keyway 80 and threads 76 to be received within holes 60 of bars 52 and by hubs 114 having key seats 117 within bores 116 of steps 110 and be positionally secured therein by keys 77 and cotter pinned nuts 79. Keyway 80, 117 and shaft holes 71 and 74 are aligned parallel to the plane of steps 110 to maintain said hinge alignments always parallel to the plane of said steps.

Handrail configurations 85 each consist of outer post 86, top rail 87 and middle telescoping rail 88 within rail 89. Post 86, with hole 94 receiving hinge shaft 106 of step 100 at spacer 82 and secured thereon by cotter pinned nut 97, has hinge plates 91 with holes 93 to be aligned with holes 93 of rail 88 to receive hinge pin 98. Rail 88 is sized to be slidably received within rail 89 which has hole 96 that is aligned with holes 48-2 in plates 37 and 39 of supporting frame 29 and secured by hinge bolting 223-1. Top rail 87, featuring a radial outer ending 99 providing a safe accessible hand grip, has hinge plates 90 with holes 92 to be aligned with hole 92 of post 86 to receive pin 98, and has hole 95 to be aligned with holes 48-1 in plate 36 and post 31 and 32 are secured by hinge bolting 223 of supporting frame 29. The hinge linkage configuration of railing 85 remains free of binding and is compatible with the ever changing sets of parallelogram hinge linkage configurations of the steps supporting hinge linkage.

Figure 17:
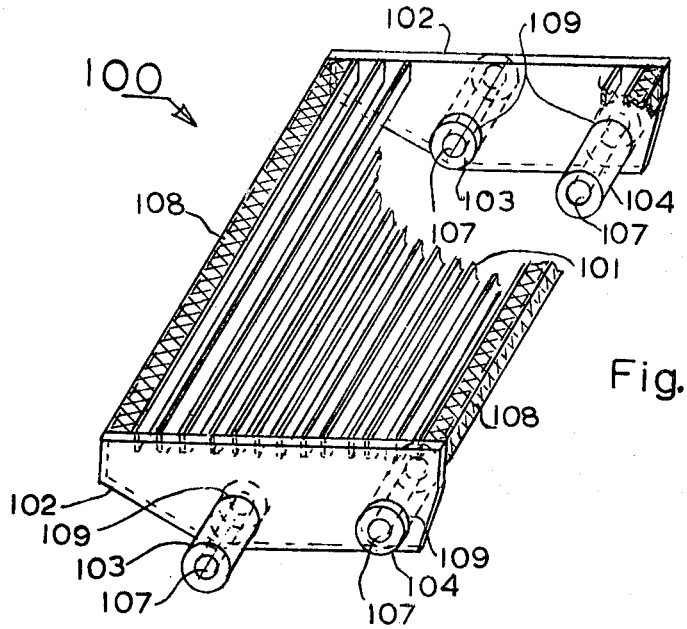
FIG. 17 is a perspective view showing the outer step 100.

Outer step 100 as seen in FIG. 17, with suitable safety grating 101 having safety nosing 108 each side, has end plates 102 affixed that have bores 109 to receive hubs 103 with bore 107 to receive hinge shaft 106 at outer side, and bores 109 to receive hubs 104 with bores 107 to receive hinge shaft 105 at the inner side. Hubs 103 and 104 are positioned and affixed within bores 109 of plates 102 and also used as spacers to align hinge bars 64 and 52 respectively.

Figure 16:
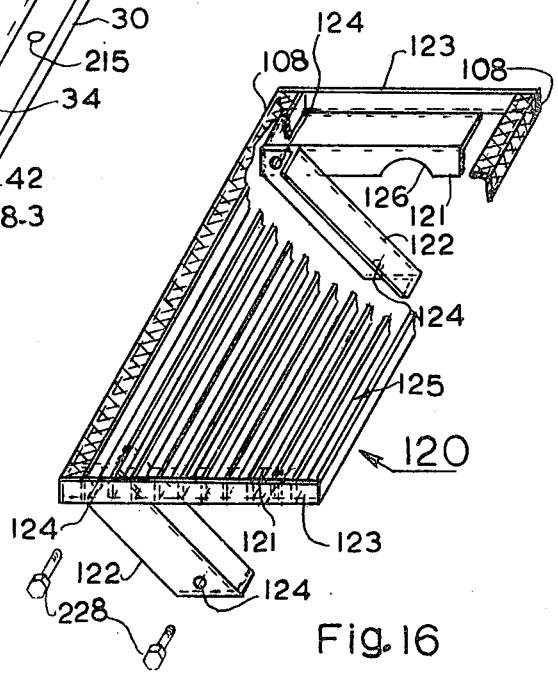
FIG. 16 is a perspective view showing the inner fixed step 120 that is subsequently affixed to supporting frame 29.

Inner step 120 as seen in FIG. 16, with suitable safety grating 125 having safety nosing 108 each side and banded ends 123, is affixed to supporting angles 121 positioned each end that have cut outs 126 to clear axle 51 of linkage bar configuration 50. Grating 125, at its inner side, is supported and affixed to the top flange of channel 34 of supporting frame 29. Angles 122 are aligned with holes 124 and secured with bolting 228 at angles 121 and lugs 42 at holes 48-3 providing a removable support for the outer side of grating 120.

Figure 18:
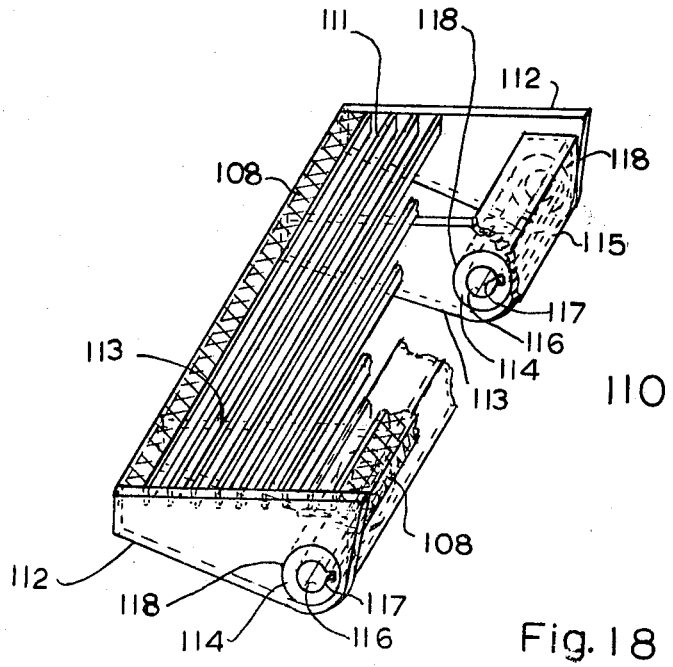
FIG. 18 is a perspective view showing the intermediate step 110.

Intermediate steps 110 as seen in FIG. 18, with suitable safety grating 111 having safety nosing 108 each side, has plates 112 affixed each end that are affixed to spacer angle 115, and bore 118 to receive hubs 114. Hub 114 is affixed to plate 112 and has keyway 117 and bore 116 to receive hinge shaft 75 of hinge 70. Positioning alignment plates 113 with bore 118 are provided at the inner ends of hubs 114 and affixed thereon as well as to angle 115 and grating 111. Keyway 117 receives key 77 of hinge 70 as previously mentioned with hinge bars 70.

Swing rotation for model 21 and model 22 level step stair walkways as seen more clearly in FIGS. 19 and 20 is provided by the use of a hydraulic hand pump 195, pumping with handle 196 for raising rotation and turning a screw pressure release provided with the pump for a slow lowering rotation, to evenly actuate a pair of hydraulic cylinders 130 that in turn actuate a pair of guidedly positioned rack type gears 135 engaged to a pair of spur drive gears 137 keyed with key 147 at keyway 141 of drive shaft 140 that is supported in bearings 200 secured to supporting frame.

A range of hydraulic hand pumps with screw pressure release are available for the level step stair walkway designs ranging from 500 to 10,000P.S.I. maximum rated pressure. Hydraulic cylinders shown have a 2,000 P.S.I. maximum rated pressure. These components are used in a manner to controllably actuate the swing rotation of models 21 and 22 of the present invention to provide a positive hydraulic lock of the walkway in a self supporting manner for pedestrian traffic in any desired position of the swing movement.

In detail, pump 195 is affixed to supporting plate 40 on post 32 of supporting frame 29. Hydraulic fluid is conducted by tubing 197, 198 and 199 to and from cylinders 130 that are secured at the top and head end at hub bore 132 with holes 47 of bracket 38 on post 31 and 32 of said frame 29 by bolting 221. Hub 133 of piston rod 131 of cylinder 130 has bore 134 that is aligned between bores 134-1 in recess 187 of rack gear 135 and secured by bolting 222. Rack gear 135 is guided tooth side by the engagement of guide gear 185 supported at its bore 186 within weldment 220, and secured by bolting 214 at holes 221, 211, also guided by the engagement with drive gear 137. Weldments 210 and 220 are positionally secured by holes 213 to post 32 and 31 respectively of frame 29 at holes 48-5 by bolting 230, and holes 212 are secured at tapped holes 49-1 in plate 44 of frame 29 both sides by bolting 229-1. Rack gear 135 is further guided by face 136, opposite tooth side, contacting surface 192 of rollers 190 as guide rims 191 each end of said rollers track the rack gear to remain vertical in other directions. Rollers 190 are positionally supported at bores 193 aligned within said support 210, and 220, at holes 211-1 and secured by bolting 214-1.

Drive shaft 140 as seen in FIGS. 19 and 20 has cylindrical surface 149 slidably received within bore 62 of axle 51 of 50 in a manner to protrude some distance past said axle each end and be rotated so keyway 141 in cylindrical surface 148 each end is in the vertical plane and positioned to receive its adjacent components. Shaft 140 is provided with key seat 142 forming abutment shoulders 144, 145 and 146 for drive key 150 contained radially by sleeve 155 as previously mentioned, abutment shoulder 143 at outer end of said surface 149 and the beginning of surface 148 containing keyway 141. Cylindrical surface 148 slidably receives bore 161 with keyway 162 of ratchet gear 160 to abut said shoulder 143 and be keyed thereon by key 147. Said surface 148 also slidably receives bore 139 with keyway 138 of drive gear 137 and be keyed thereon by key 147. The outer ends of cylindrical surface 148 of shaft 140 are received by bearings 200 that are secured to tapped holes 49 in plate 44 on frame 29 by bolting 229. Bearings 200 have lock collars to also maintain said shaft positioned axially.

Figure 10:
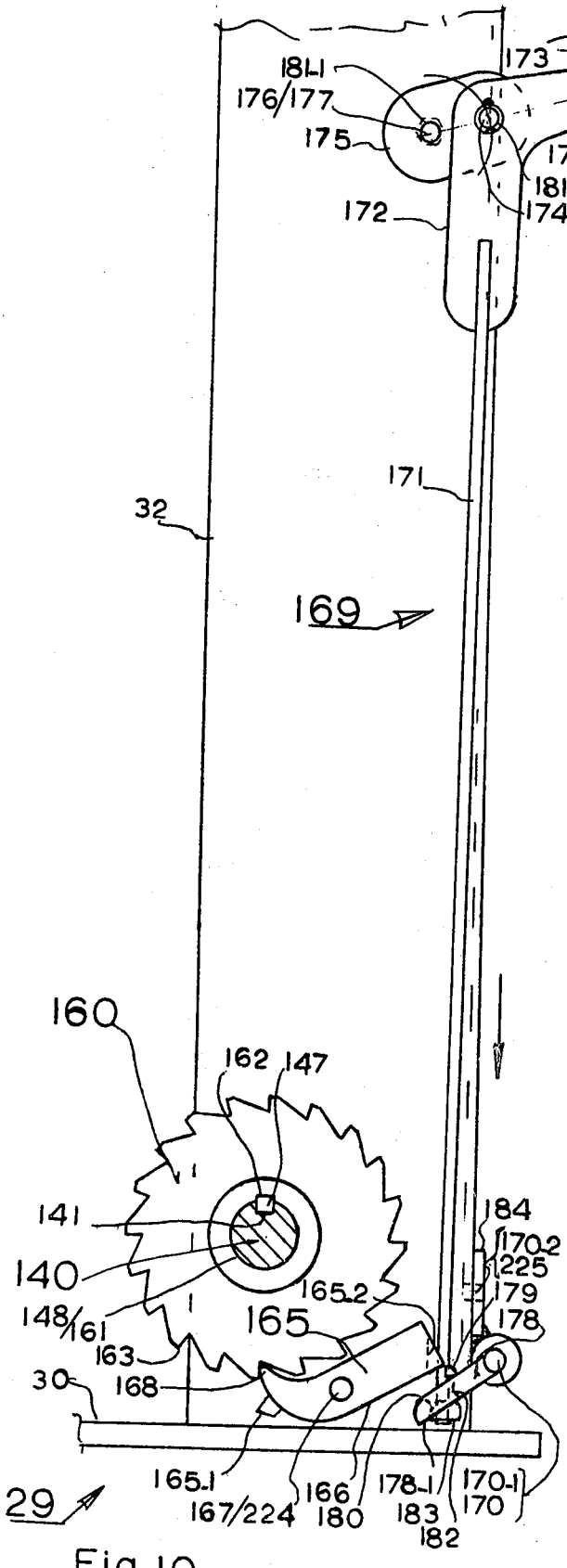
FIG. 10 is a view of the ratchet gear and pawl and control rod mechanism relation providing a safety lock when raising the steps from a lowered position.
Figure 11:
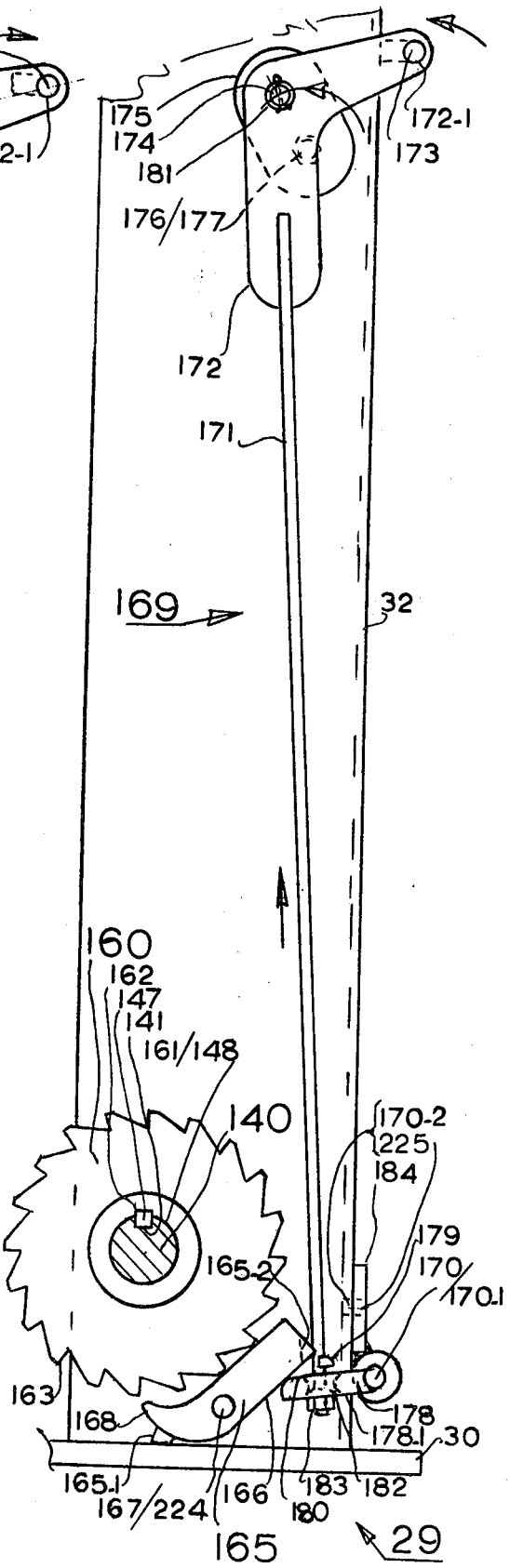
FIG. 11 is a view of the ratchet gear and pawl with the control rod mechanism positioned disengaging the pawl providing free ratchet gear movement when lowering the steps from a raised position.

Pawl 165, arrangement and control as more clearly seen in FIGS. 10, 11 and 19, is selectively positioned to provide its engagement and disengagement with ratchet gear 160 in a manner that said pawl is free of any control attachments while engaged to said ratchet. Bore 167 of pawl 165 aligned between holes 47-1 of support lugs 41 and post 31 and 32 is rotatably secured by bolting 224 so its hook 168 engages between teeth 163 at the bottom vertical center line. Notched configuration 165-2 is provided for passage of shaft link 171.

Pawl control device 169 is provided with a cross shaft 170, parallel to drive shaft 140, that is slidably received by hub bore 170-1 of support bracket 184 that has holes 170-2 for securing to post 31 and 32 at holes 48-4 by bolting 225. Trigger plate 178, to be affixed to shaft 170 after bracket 184 is positioned on shaft 170, is provided with a suitable obround hole 182 countersunk both sides to receive upright shaft link 171 that has stop lug 179 affixed aboe plate 178 and bevelled nut 183 attached below said plate to subsequently control the swing movement of said plates. Shaft link 171 at the top is affixed to plate 172 that has operating handle 173 affixed at hole 172-1, and is hinged to plate 175 at holes 181 by hinge pin 174. Plate 175 has hole 181-1 to receive threaded hinge pin 176, affixed therein, that is slidably received and supported by hole 48 in post 32 of frame 29 and secured therein by cotter pinned nut 177. As seen in FIG. 10 with pawl control handle 173 pulled out, pawl 165 is free to swing so hook end 168 engages teeth 163 of ratchet gear 160 and surface 180 of trigger plate 178 is lowered to not contact face 166 of pawl 165 during ratcheting swing movement. FIG. 11, with operating handle 173 pushed in causing hinge bar 175 to hinge about fixed hinge pin 176 and hinge pin 174 to arc counter clockwise upward actuating link 171 to swing trigger plate 178 upward as nut 183 of 171 contacts surface 178-1 of said plate, shows surface 180 of said plate contacting surface 166 of pawl 165 lifting the counterweight end of said pawl to cause counter clockwise rotation of said pawl so hook end 168 is disengaged from teeth 163 of ratchet gear 160 and said gear is free for rotating counter clockwise at step lowering.

Linkage configuration at hinge pin 176 and 174, with plate 30 of frame 29 being the stop for plate 178 at surface 178-1 when handle 173 is pulled outward, provides clockwise rotation of hinge pin 174 about fixed hinge pin 176 past the vertical axis of pin 176 so lug 179 of link 171 contacts and forces trigger plate 178 to swing downward. The weight of the linkage this position since shifted past the vertical axis of pin 176 will retain said linkage in the disengagement position as shown in FIG. 10 and permit normal movement for pawl 160. Plate 30 is also the stop for knob 165-1 affixed to pawl 165 when said pawl is rotated counter clockwise by the upward swing movement of plate 178 as previously mentioned as shown in FIG. 11. Handle 173 protrudes through hole 172-1 in plate 172 in a manner to contact post 32 to provide a stop for the linkage configuration of hinge pins 174 and 176 when handle 173 is pushed to pawl disengaging position as shown in FIG. 11 whereupon hinge pin 174 has rotated counter clockwise past the vertical axis of hinge pin 176 positioning the weight of linkage 171 to pull against the stop provided by said handle 173 to retain pawl control linkage 169 holding pawls 165 disengaged.

Figure 1:
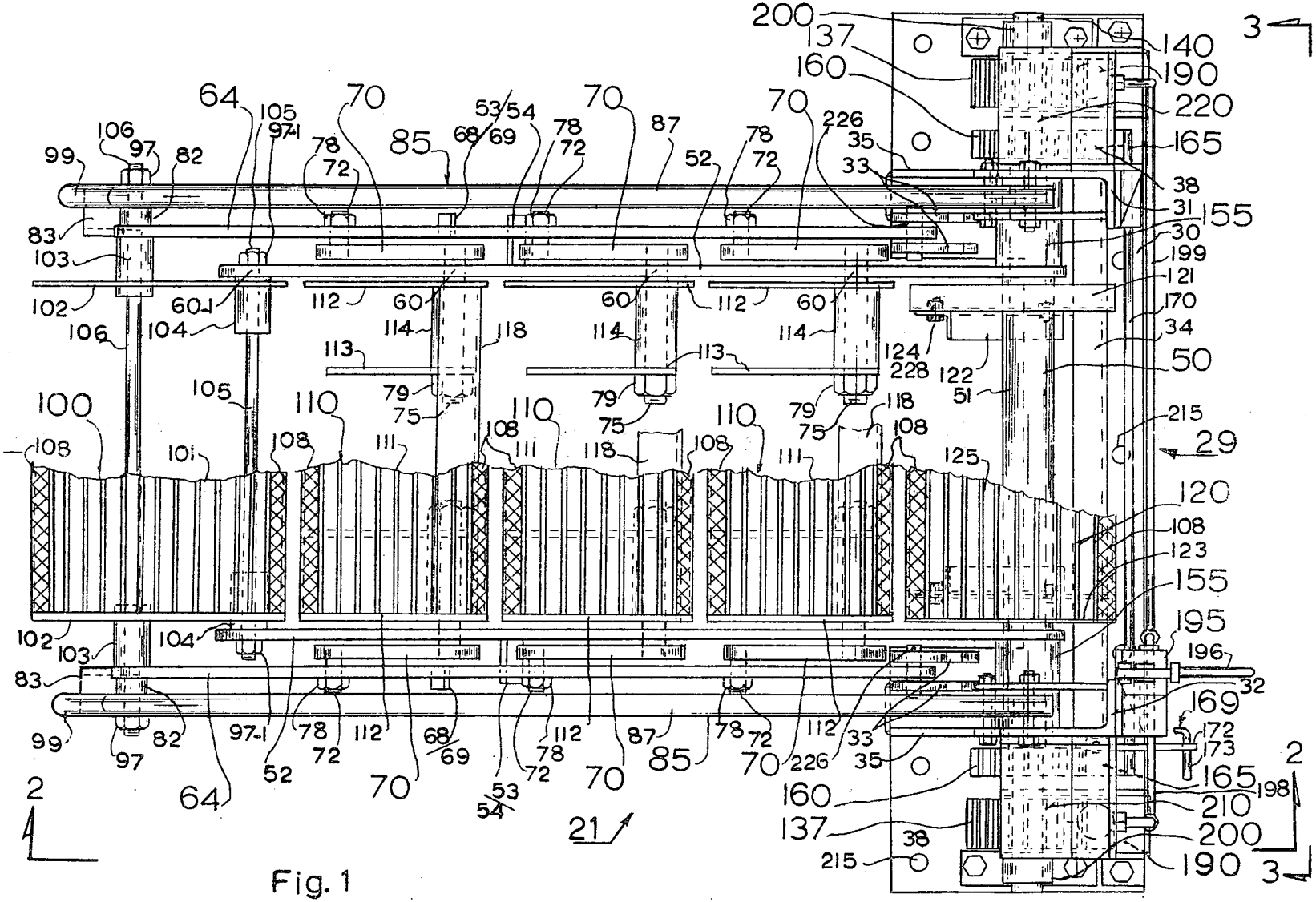
FIG. 1 is a plan view of model 21 of the present invention with the steps positioned in the horizontal plane.
Figure 2:
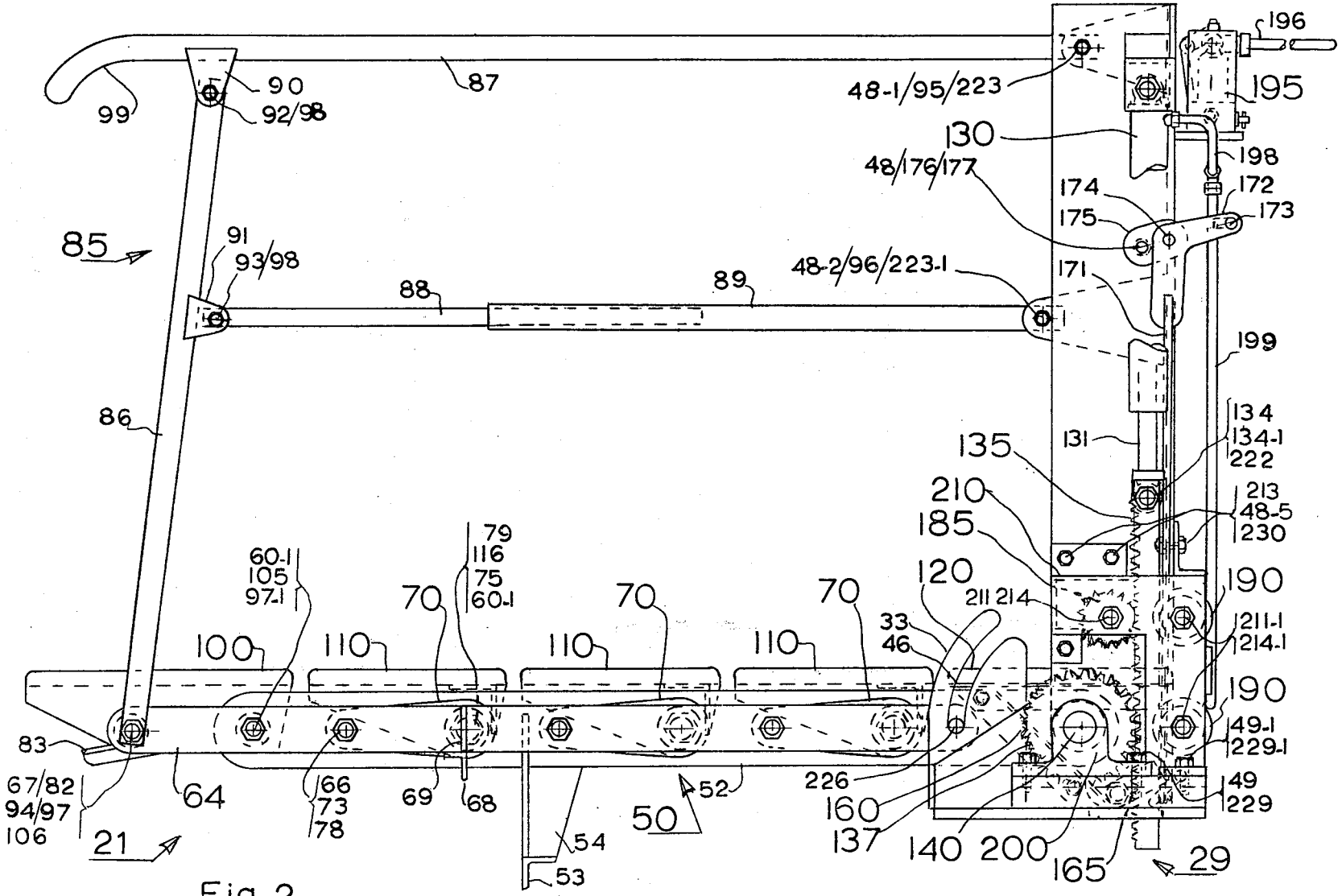
FIG. 2 is a view of an elevation taken at a plane indicated by section line 2—2 in FIG. 1.
Figure 3:
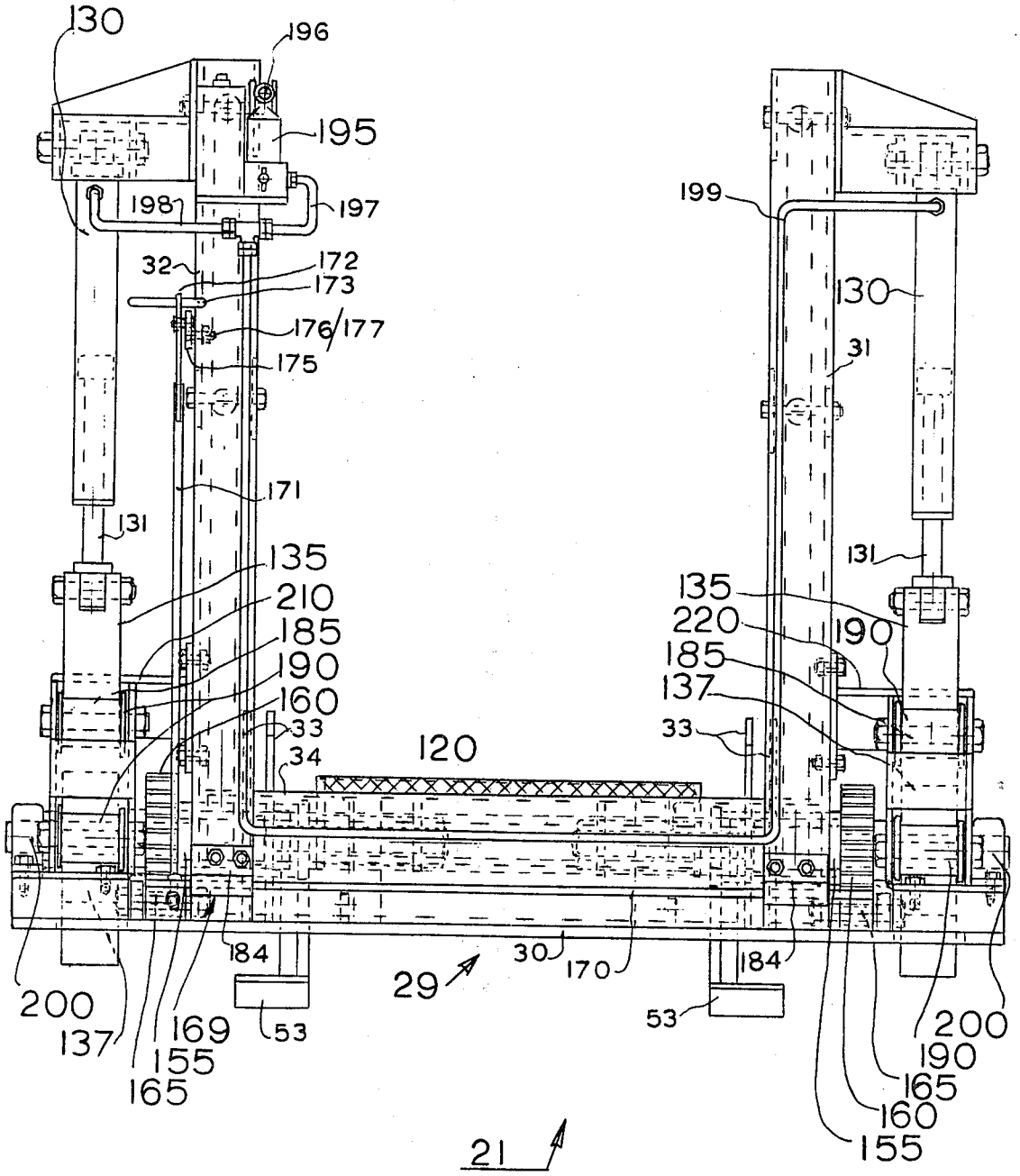
FIG. 3 is a view of an elevation taken at a plane indicated by section line 3—3 in FIG. 1.
Figure 4:
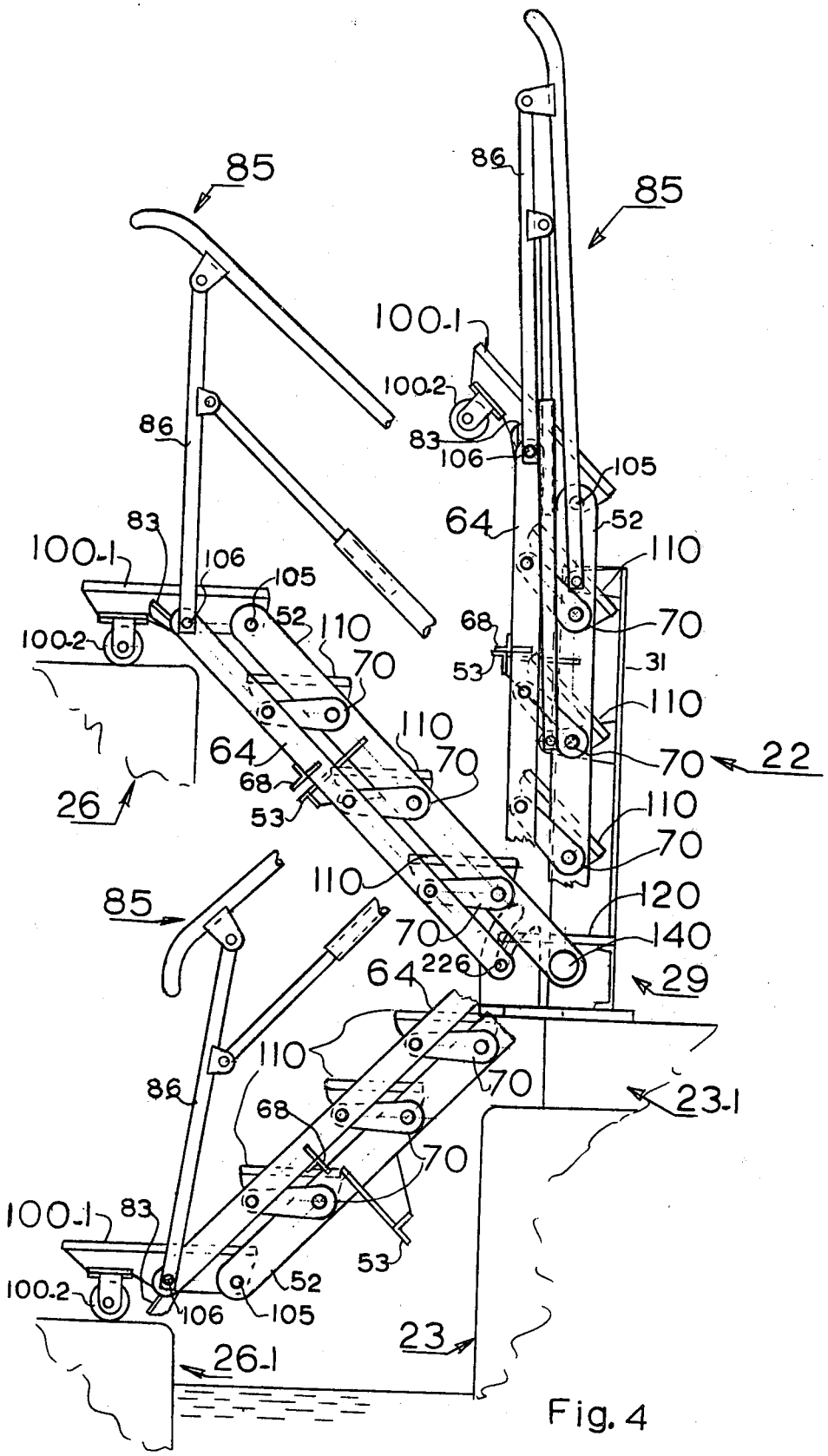
FIG. 4 is a view of an elevation of model 22 showing an adaption of the present invention at barge dockage variations.
Figure 5:
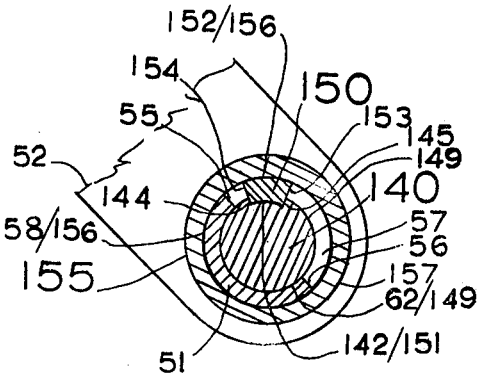
FIG. 5 is a sectional view of model 22 drive shaft, inner hinge bar axle and drive key positioning for free lowering movement at barge docks when the outer step is supported by an empty barge that is to be loaded.
Figure 6:
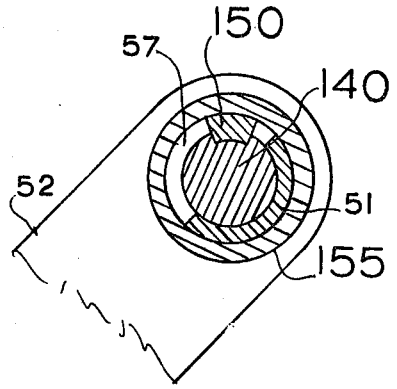
FIG. 6 is a sectional view of model 22 drive shaft, inner hinge bar axle and drive key positioning for free raising movement at barge docks when the outer step is supported by a loaded barge that is to be unloaded.
Figure 7:
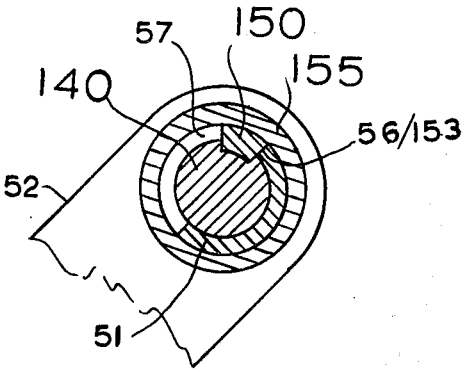
FIG. 7 is a sectional view of model 22 drive shaft inner hinge bar axle and drive key positioning when the steps are to be raised from a lowered position through the drive shaft and drive key.
Figure 8:
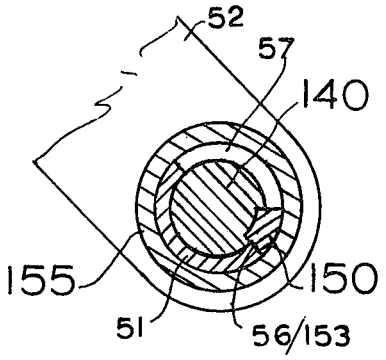
FIG. 8 is a sectional view of model 22 drive shaft, inner hinge bar axle and drive key positioning when the steps are to be lowered from a raised position through the drive shaft and drive key.

An adaption of model 22 at barge dockage in FIG. 4 shows outer step 100 replaced by step 100-1 that has swivel wheel 100-2 affixed thereunder and positioned in a manner to support the outer end of the apparatus when previously mentioned free swing movement is required. Frame 29 is shown secured to a one step high support 23-1 affixed to barge dock 23 and outer step 100-1 swivel 100-2 positioned on an empty barge 26 that is to be loaded. Said free swing permits the walkway to automatically lower as the barge is weighted down to the loaded barge elevation which is indicated as 26-1.

Figure 12:
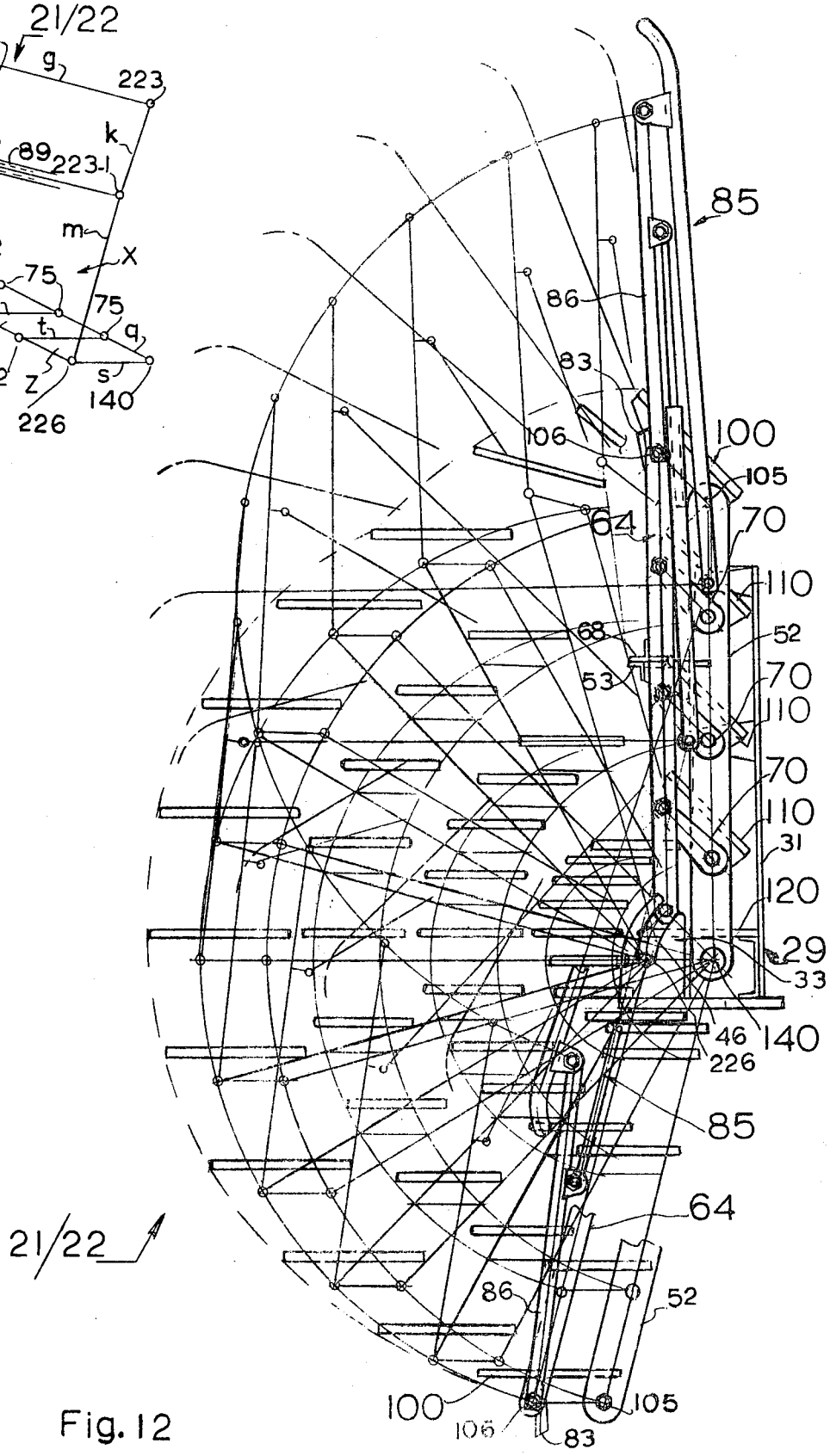
FIG. 12 is a view of an elevation projection showing the hinge movement study of the present invention with the extreme practical vertical positions indicated.
Figure 14:
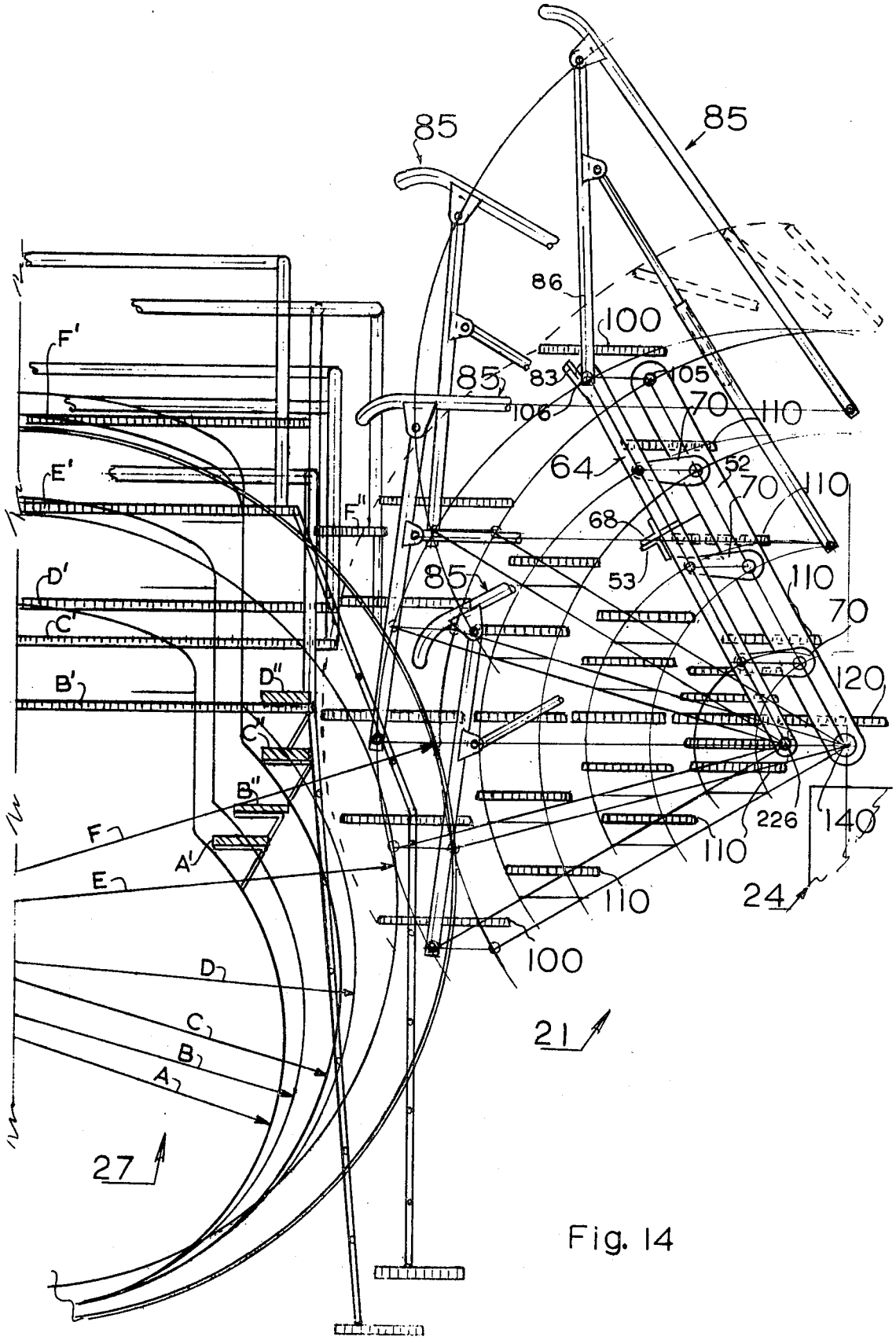
FIG. 14 is a view of an elevation showing a movement study adaptation of model 21 of the present invention in relation to a tank car overlay composite of tank cars of 6,000 gallon to 48,100 gallon capacities.

The view in FIG. 12 is an elevation of the swing curve movement of the various and changing quadrangle and parallelogram linkage hinge points from 75 degrees below the horizontal, conceivable for use in this position as an emergency escape ladder, up to the top vertical fold up standby position. The face of stop angles 53 of side bars 52 contact faces of stop angles 68 of side bars 64 at the 60 degree above the horizontal swing movement as seen in FIG. 14. The upward arc of stop angles 53 of bars 52 as said bars are swung to the upper vertical position lift bars 64 upward by stop angles 53 contacting stop angles 68 of bars 64. Hinge pins 226 of bars 64 travel upward in the fold up radial slots 46 of plates 33 of frame 29 as step 100 and steps 110 and bypass links 70 also fold upward in like fold up arcs. Whereupon stops 83 of bars 64 contact handrail post 86 to provide the desired positioning of handrail configuration 85.

Figure 13:
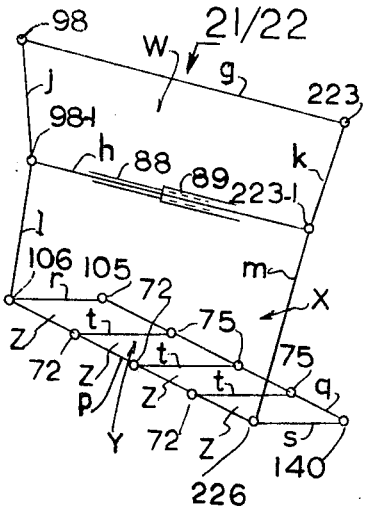
FIG. 13 is a view of an elevational projection of the hinge points and connecting sides and ends of the guadrangle and parallelogram linkage used in model 21 and 22 designs.

FIG. 13 is an elevation of the hinge point projection upon a vertical plane and lines connecting sides and ends to form the quadrangle and parallelogram configurations of the swing linkage of the level step stair walkway. Wherein quadrangle "W" with hinge points 223 and 223-1 anchored while hinge points 98 and 98-1 are free to be swung. Top side "G" connects hinge point 223 and 98, end "K" connects 223 and 223-1, end "J" connects 98 and 98-1 as side "H" connects hinge point 98-1 to 223-1. Side "H", consisting of telescoping members 88 and 89 for the purpose to adjust to the inherent length changes due to said configurations combinations, and along with hinge points 98-1 and 223-1 also form the top part of quadrangle "X". Quadrangle "X" has lower side "P" connecting hinge point 226, that is essentially anchored until the fold up operation, and hinge point 106 that is free to be subsequently swung. End "L" connects hinge point 98-1 and 106 while end "M" connects hinge point 223-1 and 226. Side "P" and hinge point 106 and 226 are common to quadrangle "X" and parallelogram "Y". Parallelogram "Y" also has hinge point 140 anchored and hinge point 105 that is free to be swung when connected to hinge point 140 by side "Q". End "S" connects hinge point 226 with 140 and end "R" connects hinge point 106 with 105. Parallelogram "Y" contains intermediate parallelograms "Z" with ends "T" parallel to end "R" of "Y" and connecting hinge points 72 on side "P" and hinge points 75 on side "Q" of parallelogram "Y". Quadrangle "W" and "X" sides and ends are essentially non-parallel during the subsequent swing movement.

Hinge points 140 and 223 are in the same vertical plane, hinge points 223-1 in a second vertical plane and hinge point 226 in a third vertical plane. Hinge points 140 and 226 are in the same horizontal plane until the fold up operation. Hinge points 223-1 are in a second horizontal plane and hinge points 223 in a third horizontal plane. It being noted that reference to hinge points will be their horizontal projection upon a vertically plane raidally positioned to the hinge axis as seen in FIGS. 12 and 13.

The above hinge linkage configurations, with fixed hinge points and to be swung hinge points as noted, upon being caused to swing clockwise from the below horizontal position as shown in FIG. 12 wherein as sides "P" and "Q" of parallelogram "Y" swing to the horizontal plane the projection of the angles of parallelograms "Y" and "Z" become zero degrees while the projection of the angles in quadrangles "W" and "X" vary in acuteness and obtuseness and essentially progressive relative to the swing movement. The clockwise swing movement continuing up past the horizontal plane causes angles to again appear in parallelograms "Y" and "Z" but reversed, such as when side "P" is below the horizontal the acute angle at "P" and hinge point 106 with end "R" is positioned below said side "P". When line "P" is above the horizontal the acute angle at "P" and hinge point 106 with end "R" is above said side "P", while ends "R", "S" and "T" of parallelograms "Y" and "Z", which govern the attitude of the steps 100 and 110, always remain positioned in relative horizontal planes during the entire swing movement until 60 degrees above the horizontal plane. Whereupon as the clockwise swing movement reaches said 60 degrees position stop 53 of bars 52, side "Q", of parallelogram "Y" contact stops 68 of bar 64, side "P", of parallelogram "Y" lifting bar 64 as said swing movement continues to the vertical. Said lifting of bar 64, side "P", with hinge pin 226 of bar 64 travelling upward in radial slots 46 provided in plates 33 of support 29 causes "R", "S" and "T" of parallelograms "Y" and "Z" to also swing upward to the desired 45 degree pitch, controlling steps 100 and 110 in the same manner, for a compact standby positioning of the apparatus.

Meanwhile quadrangle "W" and "X", with acute angles changing to obtuse angles and obtuse angles changing to acute angles from below the horizontal position to above the horizontal positioning, are further controlled to an essentially vertical position by stops 83 of bars 64 contacting posts 86, end "L" of quadrangle "X", in a manner that the configurations linkage hinge points are non-binding during the entire swing movement of the apparatus.

Since screw pressure release type hydraulic pumps are made use of it is to be noted that the fold up movement of the steps, handrail and hinge linkage is shown stopped at standby position with the steps and handrailing at an angle so an appreciable amount of the weight of the apparatus will aid the lowering operation using said screw pressure release.

FIG. 14 is an elevation of model 21 in a movement study in the various positions to service the various tank car sizes shown in an overlay composite indicated as 27 wherein letters -A- and $A^1$ represent 6,000 gallon capacity cars and service board; -B-, $B^{11}$ - and -$B^1$- represent 8,000 gallon capacity cars, service board, or service platform; -C-, -$C^{11}$- and $C^1$- represent 10,000 gallon capacity cars, service board, or service platforms; -D-, $D^{11}$- and $D^1$- represent 12,000 gallon capacity cars, service board or service platform; -E- and -$E^1$- represent 20,000 gallon capacity cars and service platforms; -F-, $F^{11}$- and $F^1$- represent 33,000 to 48,100 gallon capacity cars, step and service platforms. The advantages of the level step stair walkway 135 degree usable movement along with being self supporting, with pedestrian traffic, can readily be seen for safely servicing the widest range of tank car sizes. The movement study provides the selection of the height of platform 24 and clearance distance from the track relative to the range of tank car sizes to be serviced.

FIG. 20 is essentially a perspective view of model 22 inclined upward 45 degrees partially assembled and partially exploded in a disassembled array of the components with key components numbered as well as minor components difficult to show elsewhwere.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with a pair of vertical adjacent main parallelogram hinged linkage configurations noted as the lower structure and step support wherein each parallelogram of said pair is comprised of inner hinge linkage number 1 bars, crank type middle hinge linkage number 2 bars provided with inward shafts and outward shafts, outer hinge linkage number 3 bars, an outer step with hubs bored for shaft rotation, intermediate steps with one set of hubs bored for shaft rotation and another set of hubs bored and grooved for keyed shafts, a support frame provided with a fixed step and hinge bores, a pair of vertical adjacent quadrangular hinge linkage noted as the upper and handrailing structure is provided that control the attitude of said handrailing with one end hinge points of said quadrangles hinged at said support frame and said quadrangles having a common telescoping side centraly located and the lower side and hinge points of the lower quadrangles of said upper structure being common to and hinged to said lower structure to said pair of main parallelogram configurations provided with hinge points forming intermediate parallelograms that together control the attitude of said steps, when the end hinge points of the main parallelograms are hinged to said support frame the same end as said quadrangles, adapted to swing from 75 degrees below a centrally positioned horizontal plane to 90 degrees above said horizontal plane wherein the sides and ends of said handrailing quadrangles and step support parallelograms represent upper and lower structural linkage members respectively of a level step self adjusting stairway wherein said lower structure configurations are provided with a pair of inner hinge linkage number 1 bars hinge supported one end by said supporting frame and provided with bores to slidably receive step supporting shafting at said inward hinge hub of said outer step at the other end also bored to slidably receive said inward shafts affixed to said crank type middle hinge linkage number 2 bars each end of said intermediate steps with said inward shafts also received and keyed within hubs of said intermediate steps and bolted thereto while said outward shafts of said number 2 bars are slidably received by intermediate bores and bolted thereto in said outer hinge linkage number 3 bars that also have bores to slidably receive support shafting at said outward hubs of said outer step and are provided with fixed stub shafts the other end that are slidably and guidely received in radial slots in plates affixed to said support frame, whereupon said quadrangle and parallelogram linkage combinations provide a self adjusting horizontally level positioning of each of the moving steps above and below said horizontal plane as number 1 and 3 hinge bars are caused to swing about their hinges at said support frame wherein said handrailing hinged to be self adjusting being hinged at the outer corner of the lower quadranges at outer step support shafting through hinge bar number 3 and the upper quadrangle inward hinge points supportingly hinged by said support frame said handrailing and said steps with safety treads are adaptable to be maintained in a sturdy self supporting non-collapsible practical relative position from 75 degrees below to 60 degrees above said horizontal plane.

2. The combination of claim 1 wherein said crank type middle hinge linkage number 2 bars include the configuration as positioned to provide 360 degree swing movement of number 1 and 3 hinge linkage bars as hinged.

3. The combination of claim 1 wherein said number 1 and 3 hinge linkage bars with hinge points hinge supported one end by a supporting frame and that said bars support hinge point of member number 2 hinge bars wherein said linkage configurations include the provision for all said hinge points to be in the same horizontal plane at essentially the mid point of the swing movement.

4. The combination of claim 3 wherein said number 1, 2 and 3 hinge linkage bar hinge points are positioned, at essentially midway of the swing movement, in the same horizontal plane whereby the horizontal projection upon a radially positioned vertical plane the degree of the parallelogram angles become 0 degrees this instant.

5. The combination of claim 4 wherein said horizontal projection of the degree of the parallelogram angles become 0 degrees this instant whereupon said linkage configurations include the provisions for the reversing of the parallelogram angles, due to the manner of support for number 2 hinge link bars by number 1 and 3 link bars and the positioning of the end hinge points of number 1 and 3 hinge link bars, as the swing movement of said linkage crosses said horizontal plane as evidenced by like horizontal projections of the hinge points of the hinge linkage.

6. The combination of claim 3 wherein said number 1 and 3 hinge linkage bars with hinge points supported one end by a supporting frame and that said hinge points are in the same horizontal plane includes a manner of support that provides a practical compactness for the stairway all positions.

7. The combination of claim 1 wherein said handrailing and said steps are maintained in a sturdy non-collapsible practical safely usable relative position from 75 degrees below to 60 degrees above said horizontal plane whereupon at said 60 degree rise hinge linkage bars number 1 and 3 include configurations that provide abutment angles that abut at said 60 degree rise whereby upon the swing rise continuing up to 90 degrees said angles affixed to number 1 bars lift said angles affixed to number 3 bars causing number 3 bars and number 2 bars with steps to have an additional upward radial swing movement to a desired pitch providing a compact stand-by positioning of the stair walkway.

8. The combination of claim 7 wherein said number 3 hinge linkage bars have an additional upward radial swing movement said number 3 bars include configurations providing handrailing positioning control by selectively affixing abutment angles at the outer ends of number 3 bars positioned to abut handrail posts and guide the handrailing quadranges to approach a desired vertical fold up position.

9. The combination of claim 1 wherein said number 1 and 3 hinge bars are caused to swing about their hinges at the support frame in a controlled position self locking manner wherein the hinge configuration of number 1 bars provide for said number 1 bars to be affixed to a common axle notched each end to abut both sides of 45 degree sector drive keys and bored to receive a drive shaft fitted with said drive keys maintained in position by abutting ends and retaining sleeves for the purpose of controlling the swing movement of number 1 bars, and others, upon the rotation of said drive shaft.

10. The combination of claim 9 wherein said number 1 bars are affixed to a common axle notched to abut a drive key each end and bored to receive a drive shaft fitted with said drive keys maintained in position by abutting ends and retaining sleeves whereupon said drive shaft includes the configuration to receive a keyed gear each end to aid in providing the desired shaft rotation in a dual and balanced manner.

11. The combination of claim 10 wherein said drive shaft includes the configuration to receive a keyed gear each end to aid in providing the desired shaft rotation in a dual and balanced manner wherein said configuration includes provisions for said gears to be spur gears engaged with a guided complimentary rack gears to aid in said rotation.

12. The combination of claim 10 wherein said drive shaft includes the configuration to receive a keyed gear each end to aid in providing the desired shaft rotation in a dual and balanced manner wherein said configuration includes porvisions for said gears to be helical gears engaged with a guided complimentary rack gears to aid in said rotation.

13. The combination of claim 9 wherein said drive shaft fitted with said drive keys maintained in position by abutting ends and retaining sleeves for the purpose of controlling the swing movement of number 1 bars, and others, upon the rotation of said shaft whereon said shaft includes the configuration to receive keyed ratchet gears each end with controllable pawls to aid in locking said shaft rotation in a dual and balanced manner each desired orientation.

14. The combination of claim 11 wherein said drive shaft gearing has configurations to be engaged with guided complimentary rack gears to aid in the drive shaft rotation wherein said rack gears include configurations for each to be engaged one end to hydraulic cylinders engaged to a hydraulic system to subsequently cause said rack gears movement in a reliable safe dual and hydraulically position locking balanced manner.

15. The combination of claim 13 wherein said drive shaft receives keyed ratchet gears each end with controllable pawl engagement whereby the pawl control configuration includes push pull handle operated hinged linkage, that due to its weight being rotatingly shifted about the fixed hinge axis of hinge linkage adjacent to said handle, that remains in a given position due to a substantial weight lock provided until manually moved otherwise.

16. The combination of claim 15 wherein said pawl control with handle operated hinged linkage includes the configuration whereupon with said handle pushed in so a handle abutment contacts a support frame member a lower hinge linkage configuration is caused to rotate clockwise with affixed plates contacting and lifting the counterweighted end of the pawls in a manner that they become disengaged from their respective ratchets in order to permit counter-clockwise shaft rotation.

17. The combination of claim 15 wherein said pawl control with handle operated hinged linkage includes the configuration whereupon with said handle pulled out until movement is restricted by vertical linkage contacting the support frame bed plate the pawl control lower linkage with affixed contact plates is caused to rotate counter-clockwise in a manner that said plates lose contact with the pawls that then become free to engage the ratchet gears in normal functioning.

18. The combination of claim 14 wherein said drive shaft gearing engaged to complimentary rack gears motivated by hydraulic cylinders engaged to a hydraulic system includes the design considerations for providing a reliably safe swing movement at practical speeds at raising and lowering the stairway with a choice of speeds for said movement through the selection of the hydraulic pump to be used.

19. The combination of claim 9 wherein said number 1 bars are affixed to a common axle notched each end to abut both sides of 45 degree sector drive keys wherein said axle includes the configuration for said notches to be 180 degrees, in lieu of said 45 degree provision, providing a 135 degree free clutch shaft rotational movement and thus a "free floating" swing movement of the stairway with the outer and tip step structure supported by a barge and the like and the shaft is selectively rotated to orientate said drive keys relative to the free clutch swing movement direction contemplated to compensate for the expected vertical movement of said barge at loading and unloading said barge.

20. The combination of claim 19 wherein said outer and tip step structure supported by a barge and the like said structure includes the configuration to be adapted with a swivel wheel to contact the barge deck and then support the stairway in a manner to compensate for minor horizontal movements and inclinations of said barge and the like.

21. The combination of claim 1 wherein said handrailing and said steps are maintained in a sturdy non-collapsible practical safely usable relative position from 75 degrees below to 60 degrees above said horizontal plane wherein said handrailing includes the configuration for the outer end of the top rails to be provided with a desired curvature for readily accessible hand grip for pedestrian traffic in all said practical stair positions.

22. The combination of claim 1 wherein said number 1 and 3 hinge bars are caused to swing about their hinges at the support frame said number 1 bars include the configuration near their outer ends for adaptations of affixing cables thereto for the use of a cable winch to provide the stair swing movement.

23. The combination of claim 1 wherein said handrailing and said steps are maintained in a sturdy non-collapsible practical safely usable relative position from 75 degrees below to 60 degrees above said horizontal plane whereby, with a suitable drive mechanism arrangement attached, a self supporting stairway is provided for pedestrian traffic.

24. The combination of claim 1 wherein said handrailing and step support linkage are hinge supported by a supporting frame and said frame includes the configurations and provisions for the support of all other components of the stairway to be presented as a bolt on packaged unit.

25. The combination of claim 1 wherein said steps with safety treads include the configuration providing safety tread nosing both sides of said steps as a safety aid to pedestrians when the inclination of the stairway is above and also when below the horizontal.

* * * * *